US008066935B2

(12) United States Patent
Drambarean

(10) Patent No.: US 8,066,935 B2
(45) Date of Patent: Nov. 29, 2011

(54) TURBULENCE INHIBITING IMPACT WELL FOR SUBMERGED SHROUD OR SPRUE POURED CASTINGS

(75) Inventor: Stefan Drambarean, Attica, IN (US)

(73) Assignee: The Harrison Steel Castings Company, Attica, IN (US)

( * ) Notice: Subject to any disclaimer, the term of this patent is extended or adjusted under 35 U.S.C. 154(b) by 787 days.

(21) Appl. No.: 11/956,601

(22) Filed: Dec. 14, 2007

(65) Prior Publication Data

US 2009/0152308 A1 Jun. 18, 2009

(51) Int. Cl.
*C21B 7/12* (2006.01)

(52) U.S. Cl. ..... 266/45; 266/236; 22/590; 22/594

(58) Field of Classification Search ..... 266/236, 266/45; 222/590, 591, 594
See application file for complete search history.

(56) References Cited

U.S. PATENT DOCUMENTS

| | | | | |
|---|---|---|---|---|
| 4,334,627 | A | 6/1982 | Krishnakumar et al. | |
| 4,525,401 | A | 6/1985 | Pocock et al. | |
| 4,776,570 | A | 10/1988 | Vo Thanh et al. | |
| 5,072,916 | A | 12/1991 | Soofi | |
| 5,358,551 | A | 10/1994 | Saylor | |
| 5,518,153 | A | 5/1996 | Zacharias et al. | |
| 5,662,823 | A * | 9/1997 | Claar et al. | 222/594 |
| RE35,685 | E | 12/1997 | Schmidt et al. | |
| 6,156,260 | A | 12/2000 | Heaslip et al. | |
| 6,516,870 | B1 * | 2/2003 | Chakraborty | 164/473 |
| 6,554,167 | B1 * | 4/2003 | Barrett | 222/594 |
| 6,997,361 | B2 | 2/2006 | Zacharias et al. | |
| 7,004,227 | B2 | 2/2006 | Xu et al. | |
| 7,128,247 | B2 | 10/2006 | Retschnig et al. | |
| 7,131,482 | B2 | 11/2006 | Vincent et al. | |
| 7,468,157 | B2 * | 12/2008 | Barrett | 266/283 |
| 2002/0011696 | A1 | 1/2002 | Clark | |

FOREIGN PATENT DOCUMENTS

EP 1232814 A1 * 8/2002

* cited by examiner

*Primary Examiner* — Scott Kastler
(74) *Attorney, Agent, or Firm* — Baker & Daniels LLP

(57) ABSTRACT

An impact well configured to reduce the turbulence in a flowing fluid. The impact well has the shape of a frustum and includes an upper portion, an intermediate portion and a base portion. The base portion includes a domed portion that extends upwards into the intermediate portion. The upper portion, the intermediate portion and the base portion each included stepped areas configured to assist in the alignment of the portions and the assembly of the well.

18 Claims, 5 Drawing Sheets

TURBULENCE INHIBITING IMPACT WELL FOR SUBMERGED SHROUD OR SPRUE POURED CASTINGS

FIELD OF THE INVENTION

The present invention generally relates to poured castings utilizing molten metal, and more particularly, to an impact well configured to reduce turbulence of the molten metal or any type of fluid during the casting process.

BACKGROUND OF THE INVENTION

Generally, during a casting process molten metal is poured into a casting mold and allowed to cool in order to form a cast part. As the molten metal is poured into the casting, the molten metal typically exhibits highly turbulent flow. The turbulent flow of the metal may cause the metal to trap air and impurities which develop inclusions as the metal cools, thereby requiring additional steps to ensure the cast component meets desired quality standards. Accordingly, reducing the degree of turbulent flow of the molten metal as the metal is poured into the casting mold increases the quality of the resulting cast component.

SUMMARY OF THE INVENTION

An exemplary embodiment of the invention comprises an impact well configured to reduce the turbulent flow of a fluid being added to the well. The well includes an upper member, an intermediate member and a base member. The upper member is shaped like a frustum, and the intermediate member is shaped like a frustum. The base member includes a domed portion. The intermediate member sits on the base member, and the upper member sits on the intermediate member.

In embodiments of the invention, the upper member includes an upper portion and a side portion. The upper portion defines an opening, and the side portion defines four sides. The intermediate member includes an upper portion and a side portion, and the upper portion includes a stepped portion configured to engage a stepped portion formed in the bottom surface of the side portion of the upper member. The side portions of the intermediate member define a receiving area, and the domed portion of the base member at least partially resides within the receiving area. In embodiments of the invention, the base member includes a stepped portion configured to engage a stepped portion of the intermediate member. The well may be shaped like a frustum with four sides.

In another embodiment of the invention, an apparatus for reducing the turbulent flow of a fluid includes a side portion, a top portion and a base. The side portion defines a receiving area, and the top portion defines an opening. The base includes a top surface and a domed portion. The domed portion may extend upwards from the top surface of the base.

An embodiment of the invention includes a method of filling an impact well having the shape of a frustum and comprising an opening and a domed portion. The method may include the steps of locating a shroud or sprue configured to dispense a fluid above the domed portion of the impact well; locating the impact well in a cavity; and dispensing the fluid from the shroud or sprue.

BRIEF DESCRIPTION OF THE DRAWINGS

The above-mentioned and other features of this invention and the manner of obtaining them will become more apparent and the invention itself will be better understood by reference to the following description of an embodiment of the present invention taken in conjunction with the accompanying drawings, wherein.

Figure 1:
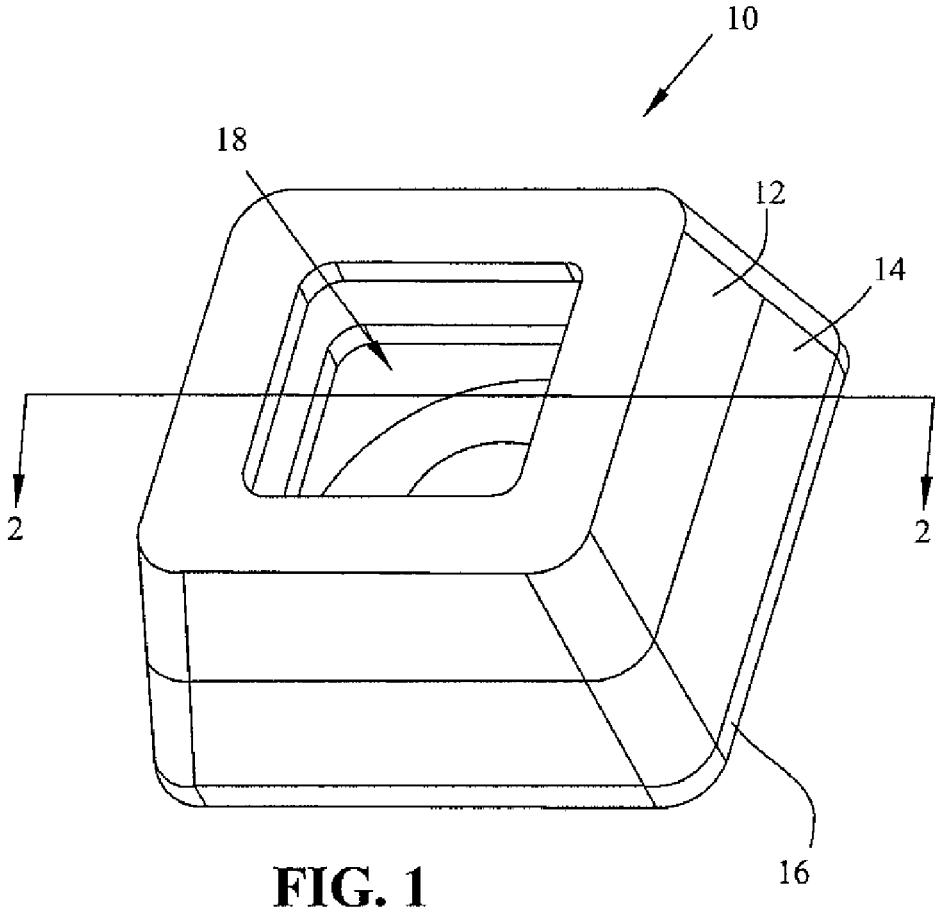
FIG. 1 depicts a perspective view of a representative embodiment of the present invention.

Although the drawings represent embodiments and various features and components according to the present invention, the drawings are not necessarily to scale and certain features may be exaggerated in order to better illustrate and explain the present invention. The exemplification set out herein illustrates an embodiment of the invention, and such exemplification is not to be construed as limiting the scope of the invention in any manner.

DESCRIPTION OF AN EMBODIMENT OF THE INVENTION

For the purposes of promoting an understanding of the principles of the invention, reference will now be made to the embodiment illustrated in the drawings, which are described below. It will nevertheless be understood that no limitation of the scope of the invention is thereby intended. The invention includes any alterations and further modifications in the illustrated device and further applications of the principles of the invention, which would normally occur to one of ordinary skill in the art to which the invention relates. Moreover, the described embodiment was selected for description to enable one of ordinary skill in the art to practice the invention.

Figure 2:
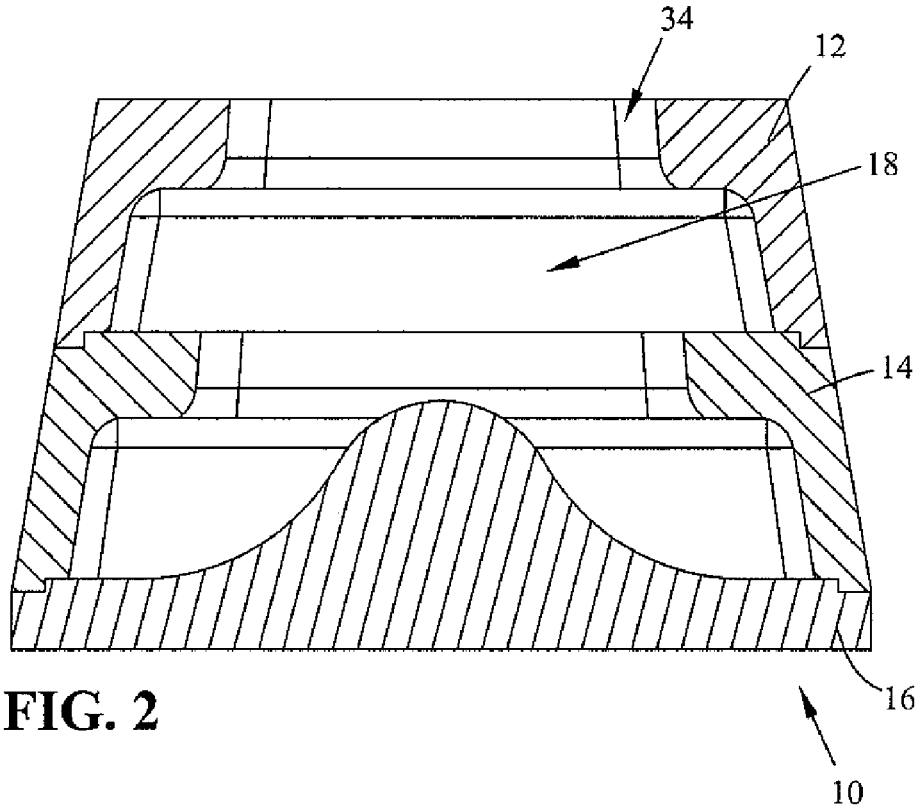
FIG. 2 depicts a section view taken along line 2-2 of the embodiment of the invention depicted in FIG. 1.

FIG. 1 depicts a perspective view of an impact well, generally indicated by numeral 10. FIG. 2 depicts a section view of impact well 10 taken along section line 2-2 in FIG. 1. In the depicted embodiment, impact well 10 includes an upper portion 12, an intermediate portion 14, a base portion 16 and a receiving area generally indicated by numeral 18. Well 10 may be manufactured from any suitable material, such as a metal, ceramic or sand with a ceramic coating, for example.

Figure 3:
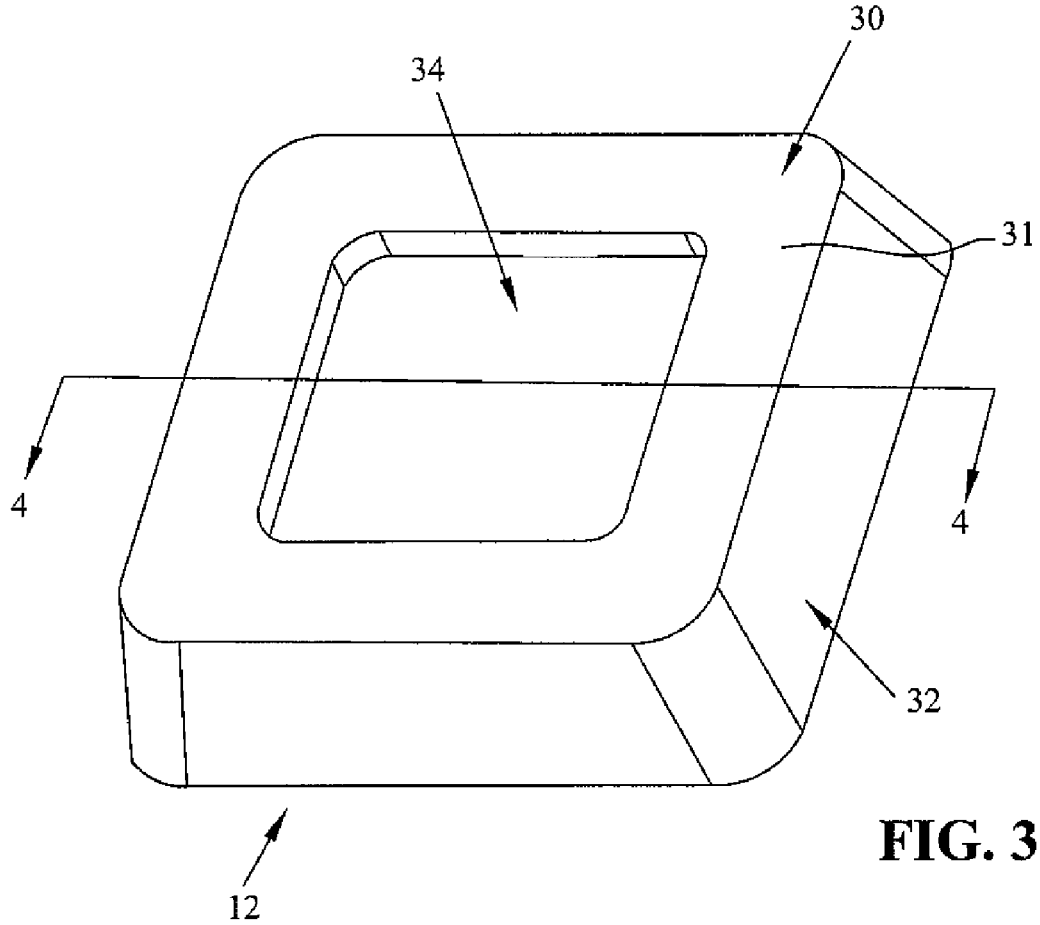
FIG. 3 depicts a perspective view of a component utilized in the embodiment of the invention depicted in FIG. 1.
Figure 4:
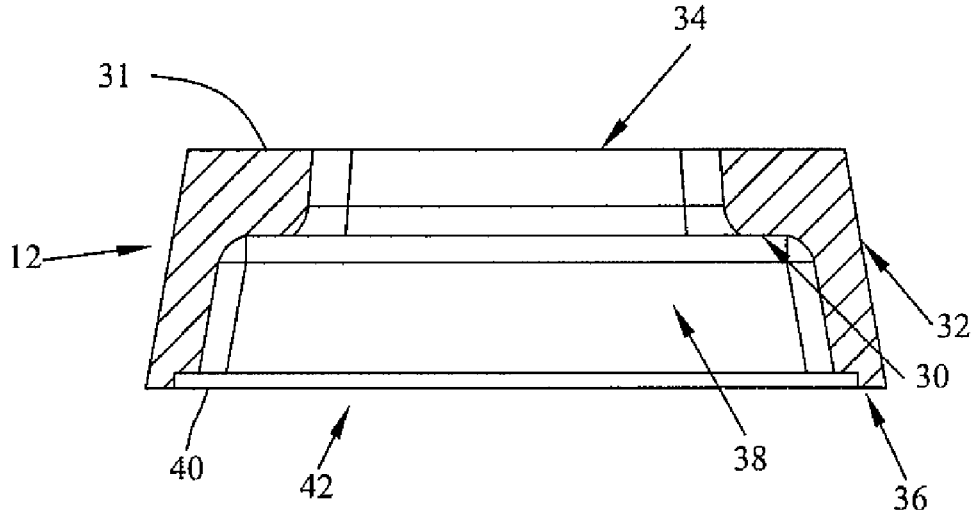
FIG. 4 depicts a section view taken along line 4-4 of the component depicted in FIG. 3.

FIGS. 3 and 4 depict upper portion 12. In the depicted embodiment, upper portion 12 generally has the shape of a frustum and includes a top portion 30 and a side portion 32. In the depicted embodiment, the top surface 31 of top portion 30 defines an opening, indicated by numeral 34. In addition, the top surface 31 of top surface 30 is substantially smooth. In the depicted embodiment, opening 34 has a substantially square shape.

Side portion 32 includes a lower surface 36 and defines a receiving area, generally indicated by numeral 38. In the depicted embodiment, lower surface 36 includes a stepped portion, generally indicated by numeral 40, and defines a lower opening, generally indicated by numeral 42. In the depicted embodiment, lower opening 42 has a square shape.

Figure 5:
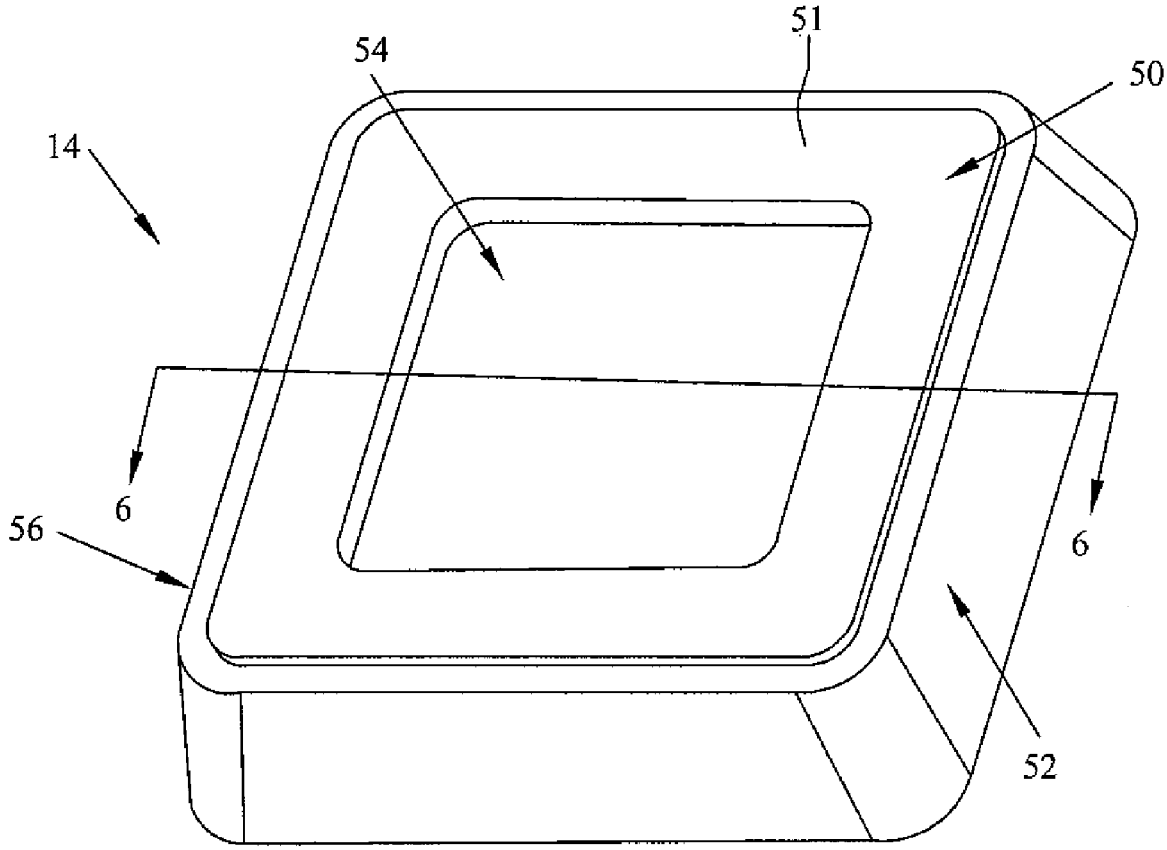
FIG. 5 depicts a perspective view of a component utilized in the embodiment of the invention depicted in FIG. 1.
Figure 6:
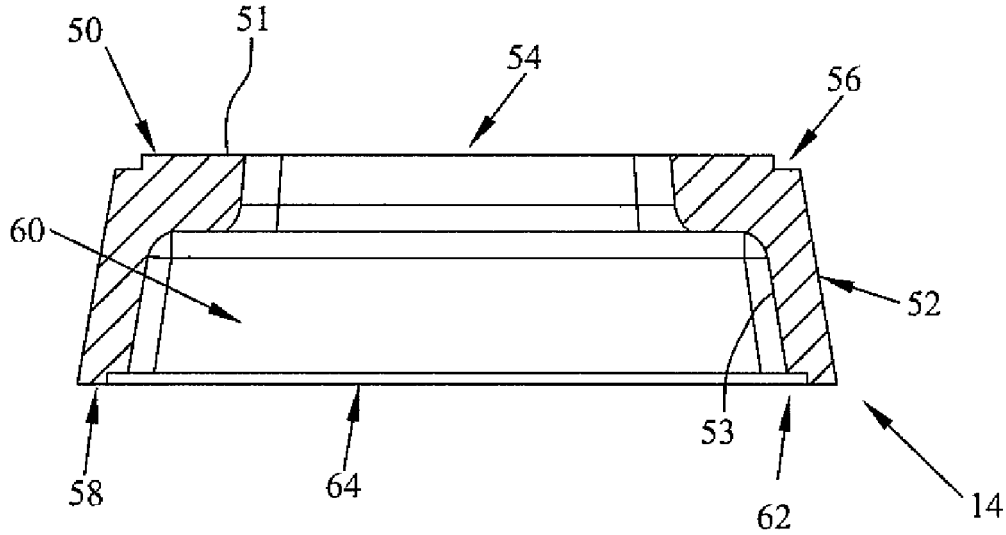
FIG. 6 depicts a section view taken along line 6-6 of the component depicted in FIG. 5.

FIGS. 5 and 6 depict intermediate portion 14. In the depicted embodiment, intermediate portion 14 includes an upper portion, indicated by numeral 50, and a side portion, indicated by numeral 52. Intermediate portion 14 has the shape of a frustum. Upper portion 50 defines an opening, indicated by numeral 54. The top surface 51 of upper portion 50 is substantially smooth and includes a stepped portion, indicated by numeral 56, located at its periphery.

Side portion 52 includes a lower surface, indicated by numeral 58. In the depicted embodiment, side portion 52 defines a receiving area, generally indicated by numeral 60. Lower surface 58 is substantially smooth and includes a stepped portion, indicated by numeral 62. Lower surface 58 defines a lower opening indicated by numeral 64.

Figure 7:
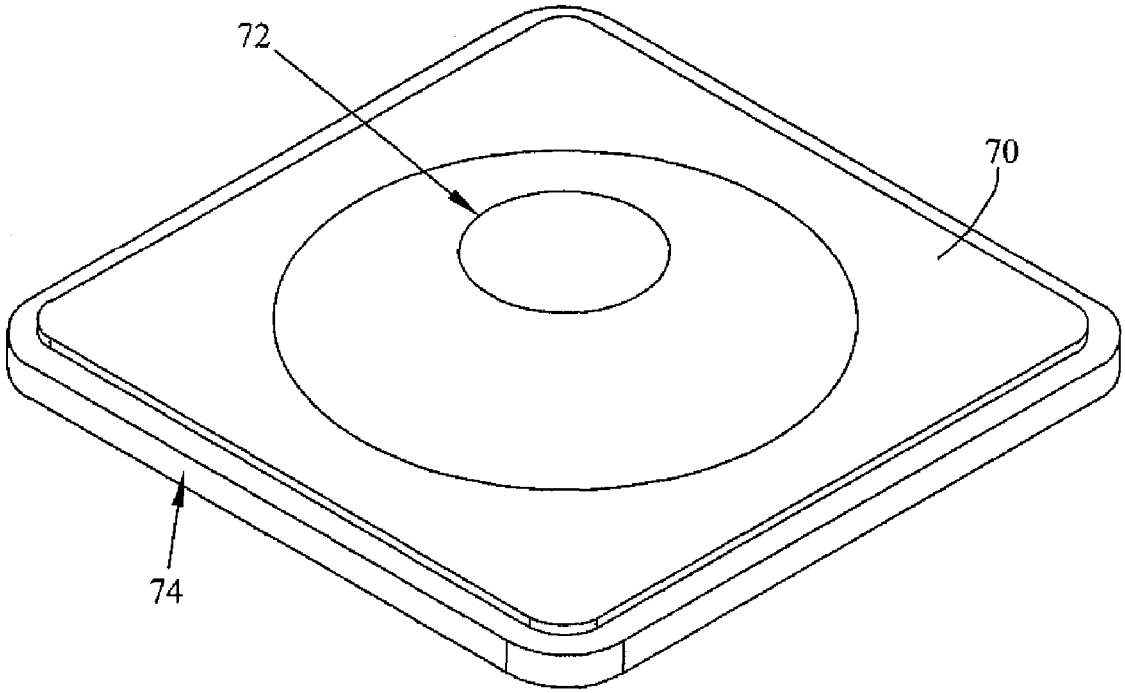
FIG. 7 depicts a perspective view of a component utilized in the embodiment of the invention depicted in FIG. 1.
Figure 8:
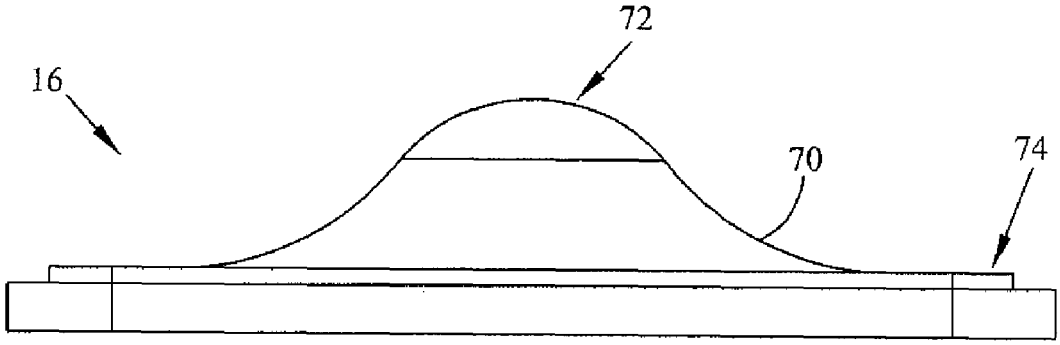
FIG. 8 depicts a section view taken along line 8-8 of the component depicted in FIG. 7.

FIGS. 7 and 8 depict base portion 16. In the depicted embodiment, base portion 16 includes a top surface 70. Top surface 70 is substantially smooth and includes a domed portion 72 and a stepped portion, indicated by numeral 74. Stepped portion 74 is located at the outer periphery of the top surface 70.

With reference now to FIGS. 1 through 8, the assembly of the well 10 will now be described. In order to assemble well 10, intermediate portion 14 is placed on base portion 16. Specifically, the stepped portion 62 of intermediate portion 14 aligns with stepped portion 74 of base portion 16. Once intermediate portion 14 has been placed on base portion 16, upper portion 12 may then be placed on intermediate portion 14. Specifically, stepped portion 40 of upper portion 12 aligns with stepped portion 56 of the intermediate portion 14.

As shown in FIG. 2, domed portion 72 of base portion 16 at least partially resides within receiving portion 60 of the intermediate portion 14. In the depicted embodiment, domed portion 72 does not extend upward a sufficient distance to reach the opening 54 of the intermediate portion 14.

Figure 9:
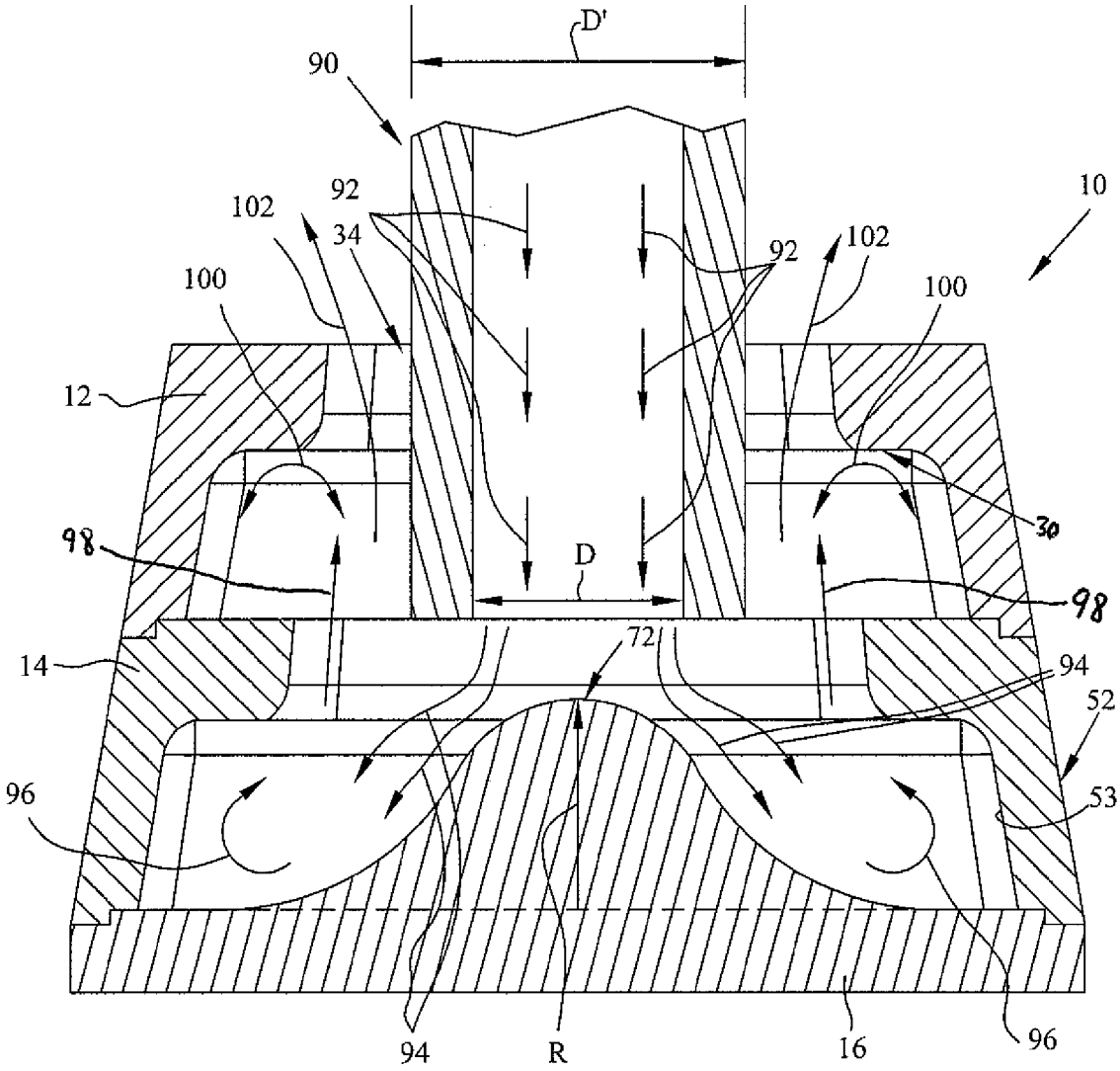
FIG. 9 depicts a section view of an embodiment of the invention demonstrating the flow patterns of a fluid.

With reference now to FIG. 9, the manner of using well 10 will now be described. In order to utilize well 10, shroud or sprue 90 is lowed into well 10 through opening 34. It should be noted that shroud 90 may be any suitable dispenser of fluid, such as a sprue. Shroud 90 extends into receiving area 18 and at least partially resides within opening 54 of intermediate portion 14. In embodiments of the invention, the shroud 90 should be located at a height above the top of the domed portion 72 that is greater than or equal to the inside diameter D of the shroud 90, and the area of the opening 54 is approximately 25% greater than the exit area 34. In addition, in embodiments of the invention, the area of the opening 34 is greater than or equal to 4 times the outer diameter D' of shroud 90. Furthermore, in embodiments of the invention, the radius R of the domed portion 72 is approximately equal to the inner diameter D of the shroud 90.

Referring still to FIG. 9, arrows 92 represent the flow of molten metal through the shroud 90. Arrows 94 represent the molten metal as the metal exits shroud 90 and contacts the domed portion 72. The molten metal flows over the surface of domed portion 72 and flows into the adjacent lower surfaces of base portion 16. The metal may then flow up the inner surface 53 of side portion 52 of the intermediate portion 14, as indicated by arrows 96. The molten metal then turns upon itself, thereby reducing some of the turbulent flow, also indicated by arrow 96.

The metal then flows through opening 54 of intermediate portion 14, as indicated by arrows 98, and at least a portion contacts the upper portion 30 of upper member 12. Opening 54 may be slightly larger than opening 34. At least some of the metal turns back upon itself after contacting upper portion 30, as indicated by arrows 100. The manner in which metal turns upon itself, as indicated by arrows 100, reduces the turbulent nature of the metal. Finally, molten metal exits the well 10 through opening 34, as indicated by numeral 102.

It should be noted that the configuration of the well 10 results in the molten metal flowing from well 10 with a substantially laminar flow. Accordingly, the addition of molten metal to the well 10 allows the molten metal to fill a cavity in which the well 10 resides with fluid flowing in a substantially laminar manner.

While the description above relates to the casting of molten metal, the well 10 may be utilized in any process in which one desires to reduce the turbulent flow of a fluid.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of filling an impact well having the shape of a frustum comprising an opening and a domed portion, including the steps of:

locating a shroud configured to dispense a fluid above the domed portion of the impact well;

providing an upper member shaped as a frustum, an intermediate member shaped as a frustum and having an inwardly extending projection extending into a cavity in the impact well, and a base member, wherein the domed portion is formed;

locating a bottom of the shroud below the opening of the impact well and within the cavity; and dispensing the fluid from the shroud.

2. The method as set forth in claim 1 wherein the fluid is molten metal.

3. The method as set forth in claim 1 wherein the fluid flows from the well in a laminar fashion.

4. The method as set forth in claim 1 wherein the area of the opening is at least four times the area of the outer surface of the shroud.

5. The method as set forth in claim 1 wherein the shroud is located a distance above the top of the domed portion greater than the inner diameter of the shroud.

6. The method as set forth in claim 1 wherein the upper member includes an upper portion and a side portion, and the upper portion includes another inwardly extending projection extending into the cavity and defining the opening.

7. The method as set forth in claim 1 wherein the intermediate member includes an upper portion and a side portion, and the inwardly extending projection is in the upper portion.

8. The method as set forth in claim 1 wherein the upper member includes a stepped portion and the intermediate member includes a stepped portion and the stepped portion of the upper member engages the stepped portion of the intermediate member.

9. An apparatus for reducing the turbulent flow of a fluid including:

a side portion defining a receiving area;

a top portion defining an opening;

a base including a top surface and a domed portion extending upwards from a top surface of the base;

a first projection extending into the receiving area from an inner surface of the side portion, the first projection being located approximately half way between a top surface of the well-and a bottom surface of the well; and a second projection extending into the receiving area and located above the first projection.

10. The apparatus as set forth in claim 9 wherein a top point of the domed portion is below the second projection.

11. The apparatus as set forth in claim 9 further including an upper member, an intermediate member and a base member.

12. The apparatus as set forth in claim 11 wherein the upper member includes a stepped portion configured to engage a stepped portion of the intermediate portion.

13. The apparatus as set forth in claim 12 wherein the base member includes the domed portion.

14. The method as set forth in claim 6 wherein the bottom of the shroud is located below the projection in the upper member and approximately at the same height as an upper end surface of the projection in the intermediate member.

15. The apparatus as set forth in claim 9 wherein the second projection extends in further towards a center of the apparatus than the first projection.

16. The apparatus as set forth in claim 15 wherein the first projection defines an opening in the receiving area, and the opening in the first projection is larger than the opening defined by the top portion.

17. The apparatus as set forth in claim 9 wherein a top of the domed portion is located at a height above a bottom surface of the first projection.

18. The apparatus as set forth in claim 9 wherein the side portion has a frustum shape so that the first projection extends outwardly from a center of the apparatus farther than the second projection.

* * * * *